US005473900A

United States Patent [19]

Low

[11] Patent Number: 5,473,900

[45] Date of Patent: Dec. 12, 1995

[54] METHOD AND APPARATUS FOR LIQUEFACTION OF NATURAL GAS

[75] Inventor: William R. Low, Bartlesville, Okla.

[73] Assignee: Phillips Petroleum Company, Bartlesville, Okla.

[21] Appl. No.: 235,775

[22] Filed: Apr. 29, 1994

[51] Int. Cl.[6] ..... F25J 1/00

[52] U.S. Cl. ..... 62/9; 62/40

[58] Field of Search ..... 62/38, 39, 9, 40

[56] References Cited

U.S. PATENT DOCUMENTS

| | | | |
|---|---|---|---|
| 2,900,796 | 8/1959 | Morrison | 62/9 |
| 2,903,858 | 9/1959 | Bocquet | 62/9 |
| 2,996,891 | 8/1961 | Tung | 62/9 |
| 3,616,652 | 11/1971 | Engel | 62/9 |
| 3,735,600 | 5/1973 | Dowdell | 62/9 |
| 4,172,711 | 3/1979 | Bailey | 62/21 |
| 4,195,979 | 4/1980 | Martin | 62/26 |
| 4,322,225 | 3/1982 | Bellinger et al. | 55/27 |
| 4,456,459 | 6/1984 | Brundige, Jr. | 62/9 |
| 4,923,492 | 5/1990 | Hewitt | 62/11 |
| 5,006,138 | 4/1991 | Hewitt | 62/18 |
| 5,291,736 | 3/1994 | Paradowski | 62/20 |

OTHER PUBLICATIONS

"Liquified Natural Gas, Refrigeration Cycles" and Liquified Petroleum Gas. A A. Description, Properties, Recovery, and Treating, *Encyclopedia of Chemical Processing and Design*, vol. 28, pp. 213–233.

*Oil and Gas Journal*, Jul. 13, 1981, "Gas Processing", pp. 82–87.

*Encyclopedia of Chemical Technology*, Third Edition, vol. 14, "Liquified Petroleum Gas", pp. 382–389.

*McGraw–Hill Encyclopedia of Science & Technology*, 6th Edition, vol. 15, "Regrigeration" pp. 257–264.

*Oil & Gas Journal*, Jul. 15, 1985, "LPG Extraction Process Cuts Energy Needs", pp. 81, 82, 84 and 88.

"Turboexpanders", pp. 13–40–13–47.

*Primary Examiner*—Ronald C. Capossela
*Attorney, Agent, or Firm*—Ryan N. Cross

[57] ABSTRACT

A process and apparatus for liquefying a natural gas, having a pressure above about 800 psig, in which the natural gas is introduced into an expander which operates to reduce the pressure of the natural gas and extract work from the expansion of the natural gas during the pressure reduction so that the resulting effluent from the expander can be cooled to sequentially lower temperatures by passing the gas through a plurality of cooling stages, in indirect heat exchange with at least one refrigerant, until the gas is substantially completely condensed in the last of the cooling stages.

12 Claims, 1 Drawing Sheet

METHOD AND APPARATUS FOR LIQUEFACTION OF NATURAL GAS

BACKGROUND OF THE INVENTION

The present invention relates to a refrigeration process for liquefying a gas. More particularly, the present invention relates to a method and apparatus for the liquefaction of natural gas which is more energy efficient than prior methods and apparatuses and, thus, more economical.

Numerous reasons exist for the liquefaction of gases and particularly of natural gas. The primary reason for the liquefaction of natural gas is that the liquefaction reduces the volume of a gas by a factor of about 1/600, thereby making it possible to store and transport the liquefied gas in container of more economical and practical design.

For example, when gas is transported by pipeline from the source of supply to a distant market, it is desirable to operate under a substantially constant high load factor. Often the capacity will exceed demand while at other times the demand may exceed the capacity of the pipeline. In order to shave off the peaks where demand would exceed supply, it is desirable to store the gas when the supply exceeds demand, whereby peaks in demand can be met from material in storage. For this purpose it is desirable to provide for the storage of gas in a liquefied state and to vaporize the liquid as demand requires.

Liquefaction of natural gas is of even greater importance in making possible the transport of gas from a source of plentiful supply to a distant market, particularly when the source of supply cannot be directly joined with the market by pipeline. This is particularly true where transport must be made by ocean going vessels. Ship transportation in the gaseous state is uneconomical unless the gaseous material is highly compressed, and even then the transportation system would not be economical because it is impractical to provide containers of suitable strength and capacity.

In order to store and transport natural gas, the reduction of the natural gas to a liquefied state requires cooling to a temperature of about −240° F. to −260° F. at atmospheric pressure.

Numerous systems exist in the prior art for the liquefaction of natural gas or the like in which the gas is liquefied by passing it sequentially through a plurality of cooling stages to cool the gas to successively lower temperatures until the liquefaction temperature is reached. Cooling is generally accomplished by indirect heat exchange with one or more refrigerants such as propane, propylene, ethane, ethylene, and methane which are expanded in a closed refrigeration cycle. Additionally, the natural gas is expanded to atmospheric pressure by passing the liquefied gas through one or more expansion stages. During the course of the expansion, the gas is further cooled to a suitable storage or transport temperature and its pressure reduced to atmospheric pressure. In this expansion to atmospheric pressure significant volumes of the natural gas are flashed. The flashed vapors from the expansion stages are generally collected and recycled for liquefaction or else burned to generate power for the liquid natural gas manufacturing facility.

Often the natural gas feed stream is transferred to the liquid natural gas manufacturing facility at an elevated pressure. Generally, when this pressure is above approximately 650 psig, the feed gas pressure must be reduced before the gas feed stream can undergo the cooling stages of the liquefaction process. In the past, such depressurization has been carried out by Joule-Thomson expansion, or constant enthalpy expansion, and has resulted in a reduced pressure and temperature for the gas feed stream. Such expansions are uneconomical and wasteful because the gas expands without doing any useful work.

SUMMARY OF THE INVENTION

It is, therefore, an object of the present invention to overcome the disadvantages of a Joule-Thomson expansion and, thus, to provide a more economical and efficient liquid natural gas manufacturing facility.

Another object of the present invention is to provide an improved process and apparatus for the liquefaction of natural gas that takes advantage of the elevated pressure of the gas feed stream coming into the liquid natural gas manufacturing facility so that work is extracted from the expansion of the gas before cooling.

In accordance with the present invention, there is provided a liquid natural gas manufacturing facility which includes an expander which recovers useful work from the expansion of a gas stream. The expander operates prior to refrigeration of a pressurized natural gas feed stream to reduce the pressure of the feed stream and to extract work from the expansion of the feed stream during the pressure reduction.

According to another aspect of the invention, there is provided a process for producing liquefied natural gas comprising: feeding the pressurized natural gas feed stream, at a pressure above about 800 psig and at about ambient temperature, to an expander prior to refrigeration of the feed stream; conducting the feed stream through the expander to reduce the pressure of the stream to a pressure below about 650 psig and to cool the stream to a temperature below ambient temperature; extracting work from the feed stream during the reduction of pressure by means of the expander; and feeding the effluent stream of the expander to a refrigeration cycle of the process to produce a liquefied natural gas stream.

DETAILED DESCRIPTION OF THE PREFERRED EMBODIMENTS

Figure 1:
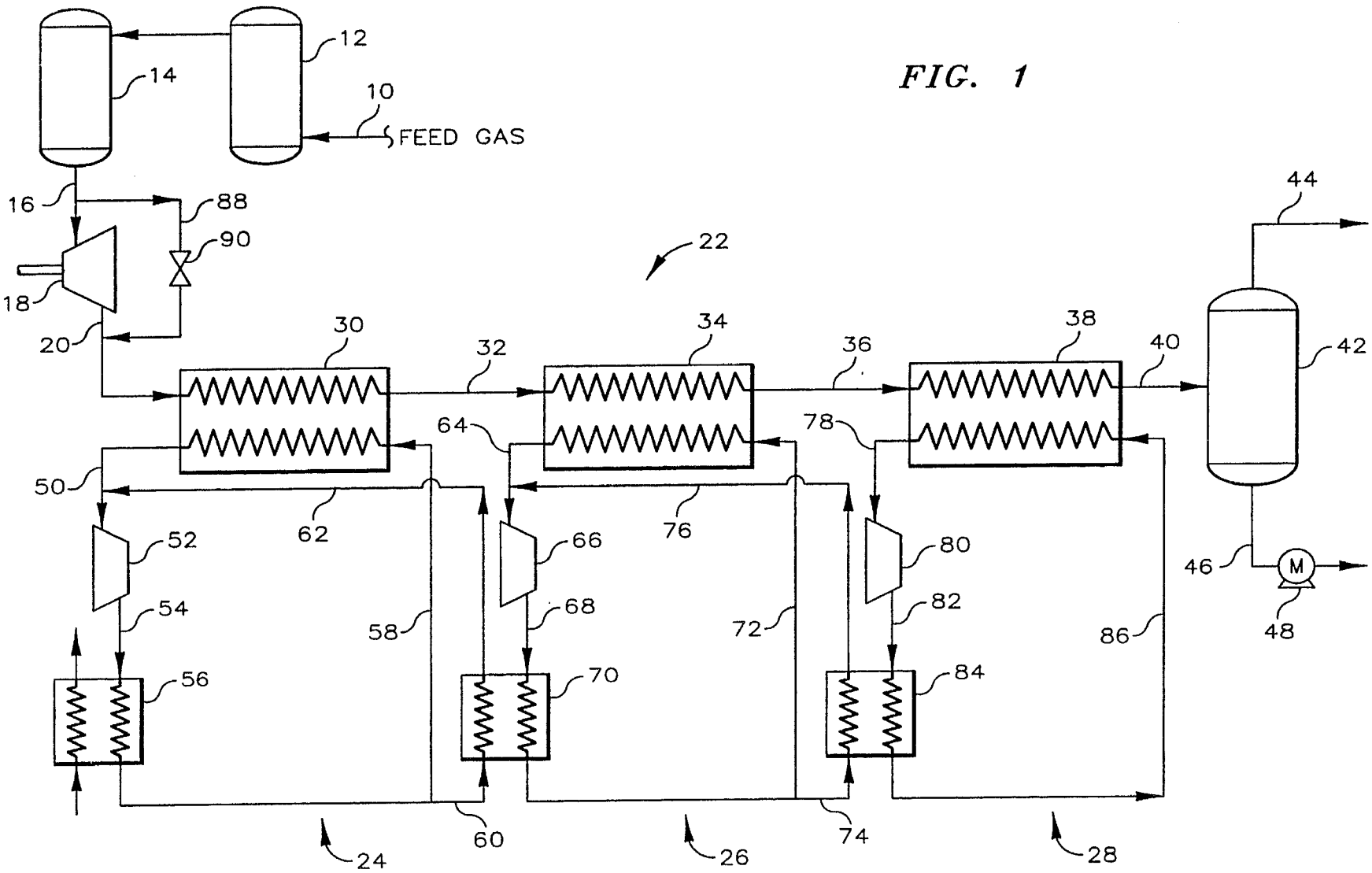
FIG. 1 shows a simplified flow diagram of a liquefaction process according to the present invention.

The detailed description of the present invention will be made with reference to the liquefaction of a lean natural gas and specific reference will be made to the liquefaction of a lean natural gas having an initial pressure of above about 800 psig at ambient temperature. Preferably, the lean natural gas will have an initial pressure of above about 1000 psig at ambient temperature, and most preferably above about 1200 psig at ambient temperatures. It is to be understood that, where reference is made to a lean natural gas, this term refers to a gas that is predominantly methane, for example, 85% by volume methane with the balance being ethane, higher hydrocarbons and nitrogen.

Referring now to the drawing, the pressurized lean natural gas feed stream at ambient temperature is introduced to the system through line 10. In particular, the feed gas is at a pressure above 800 psi as previously stated. The subject feed gas is pretreated to remove acid gases such as carbon dioxide, hydrogen sulfide and the like by desiccation, amine extraction and the like in pretreater 12. The feed stream is also treated in dehydrator 14 to remove the water from the natural gas stream. The water must be removed to prevent freezing and plugging of the lines and heat exchangers at the temperatures encountered in the process. Dehydrator 14 contains a common gas desiccant such as a molecular sieve.

The pretreated gas stream exiting dehydrator 14, which is at substantially the same pressure and temperature as the incoming gas feed stream, is next passed through conduit 16 into an expander 18. The expander may consist of a commercially available turboexpander, as heretofore commonly utilized in industry for letdown turbines, the treatment of gases, or in connection with water-base systems. In the inventive application, the expander 18 is employed for the purpose of extracting work from the natural gas feed stream during pressure reduction so as to produce an effluent which is still predominantly gaseous but at a substantially reduced pressure. The resulting effluent will have up to 18% of the natural gas component liquefied. Additionally, the effluent will be at a pressure below about 650 psig and at a reduced temperature typically below about 0° F. Preferably, the effluent exiting expander 18 will be at a pressure between about 600 psig and 650 psig.

The effluent extracted from expander 18 is conducted through conduit 20 the refrigeration cycle of the liquid natural gas manufacturing facility. It is preferred that the refrigeration cycle is carried out in a cascade refrigeration cycle, as illustrated in FIG. 1.

For simplicity, FIG. 1 illustrates the cascade refrigeration cycle 22 as only having a single evaporating pressure and compression stage for each refrigerant. In reality, refrigeration is supplied over many discreet temperatures. While any number of cooling stages may be employed, depending upon the composition, temperature and pressure of the feed gas, typically, the cascade refrigeration cycle will comprise propane refrigeration cycle 24, ethylene refrigeration cycle 26 and methane refrigeration cycle 28.

As illustrated in FIG. 1, effluent in conduit 20 is cooled in propane refrigeration cycle 24 by indirect heat exchange with propane in heat exchanger 30. From heat exchanger 30 the effluent flows through conduit 32 into heat exchanger 34 where the effluent undergoes indirect heat exchange with ethylene from ethylene refrigeration cycle 26. Effluent from heat exchanger 34 flows through conduit 36 into heat exchanger 38 where the effluent undergoes indirect heat exchange with methane from methane refrigeration cycle 28. The effluent from heat exchanger 38 is transferred via conduit 40 into low pressure flash unit 42 where the effluent stream's pressure is reduced and vapor or flash gas is separated from the liquid natural gas. Vapor or flash gas is separated out and conducted into conduit 44, whereas the separated liquid natural gas is conducted into a conduit 46 from which it is pumped into a liquid natural gas storage tank (not shown) through the intermediary of a suitable transfer pump 48. The resulting liquid natural gas is at a temperature below the boiling point of liquid natural gas, about −258° F., and at about atmospheric pressure.

At least a portion of the cooling of the effluent in heat exchanger 30 is caused by the absorption of heat during the at least partial evaporation of propane within heat exchanger 30. From heat exchanger 30 the propane is conveyed via conduit 50 to compressor 52 where the propane is recompressed with the vapor being returned to a liquid form. Propane withdrawn from compressor 52 is conveyed to heat exchanger 56 via conduit 54 where the compressed propane is cooled by indirect heat exchange with a heat exchange fluid such as sea water. Additionally, the propane could be cooled by another heat exchange means such as an air fin cooler. At least a portion of the propane from heat exchanger 56 is returned to heat exchanger 30 via conduit 58. A second portion of the propane from heat exchanger 56 enters heat exchanger 70 via conduit 60 where the propane cools ethylene by indirect heat exchange, wherein the propane undergoes expansion. Subsequently, the propane is returned to the compressor via conduit 62.

Similarly, ethylene leaving heat exchanger 34 through conduit 64 is compressed in compressor 66. After which the compressed ethylene is conveyed via conduit 68 to heat exchanger 70 where it is cooled by indirect heat exchange with propane. The cooled compressed ethylene is then split into two streams. The first stream is conveyed via conduit 72 to heat exchanger 34. The second stream is conveyed via conduit 74 to heat exchanger 84 where it cools methane by indirect heat exchange. Ethylene from heat exchanger 84 is conveyed via conduit 76 back to compressor 66.

Finally, methane refrigeration cycle 28 follows a similar cycle to those of propane refrigerant cycle 24 and ethylene refrigerant cycle 26. Methane from heat exchanger 38 is conveyed via conduit 78 to compressor 80 after undergoing heat exchange with the natural gas effluent within heat exchanger 38. Within compressor 80 the methane is recompressed and then is transferred to heat exchanger 84 via conduit 82. Within heat exchanger 84 the methane is cooled by indirect heat exchange with ethylene. Compressed, cooled methane from heat exchanger 84 is then conveyed back to heat exchanger 38 for further heat exchange with the natural gas effluent by conduit 86.

While a simplified cascade refrigeration cycle has been described with reference to FIG. 1, the invention is not limited to a particular cascade refrigeration cycle, but, rather, is applicable to many varieties of cascade closed loop refrigeration cycles.

The expander 18 which, as indicated hereinabove, may be a commercial type of turboexpander, may be shaft-coupled to suitable compressors, pumps or generators, enabling the work extracted from the natural gas by the expander to be converted into usable mechanical and/or electrical energy thereby resulting in a considerable energy savings to the overall system.

In the embodiment of the invention as illustrated in FIG. 1, a conduit 88 connects into conduit 16 and conduit 20 in a parallel bypass flow relationship with respect to the expander 18. Interposed in conduit 88 is a Juole-Thomson valve 90, as is currently known in the technology. During operation of the expander 18, the Joule-Thomson valve is in a closed position so as to preclude the flow of any liquid natural gas through the conduit 88. In essence, causing the entire flow of natural gas feed stream entering the manufacturing facility to flow through the expander.

The utilization of the Joule-Thomson valve in a flow by-pass relationship with the expander will ensure that during periods when the expander is inoperative, such as during repairs of replacement, the refrigeration system may continue operating without any significant downtime being encountered although, temporarily, at a reduced efficiency in the output or yield of liquid natural gas.

The invention will be further illustrated by the calculated Example set forth below.

EXAMPLE

This example was calculated for a lean natural gas feed stream having an initial pressure of 1295 psia and an initial temperature of 40° F. The model utilized in the example was a cascade refrigeration cycle requiring an inlet feed gas pressure in the approximate range of 600 psig to 650 psig. It was calculated that using a turboexpander to expand the natural gas feed stream to a pressure of 630 psia would result in production of 9044 BHP (brake horse power). The feed gas bulk temperature would drop from 40° F. to −27° F. resulting in liquefaction of 2.9% of the feed. With such a temperature and pressure drop, the need for a propane refrigeration cycle would be reduced so that if desired, only the ethylene and methane refrigeration cycles would need to be used.

Thus, the use of the turboexpander would not only result in an economical savings from the production of 9055 BHP but also would result in savings from the elimination of the need to process the natural gas feed in a propane refrigeration cycle.

While there has been shown and described what is considered to be a preferred embodiment of the invention, it will of course be understood that various modifications and changes in form or detail could readily be made without departing from the spirit and scope of the invention.

That which is claimed is:

1. An apparatus comprising:

pretreater means;

means for introducing a lean natural gas stream at a pressure above about 800 psig and at about ambient temperature to said pretreater means;

closed cycle refrigeration means for cryogenically liquefying said natural gas stream by indirect heat exchange with at least one refrigerant; and an expander operatively connected between said pretreater means and said refrigeration means for reducing the pressure of said natural gas stream and extracting useful work from said natural gas stream during the pressure reduction wherein said expander is in fluid flow communication with said pretreater and said refrigeration means such that said expander receives said natural gas stream from said pretreater and after pressure reduction, introduces said natural gas stream to said refrigeration means.

2. An apparatus according to claim 1 wherein said refrigeration means is a cascade refrigeration system which receives natural gas effluent from said expander and expands and cools said effluent to about atmospheric pressure and to a temperature below about −258° F. by indirect heat exchange with at least two refrigerants.

3. An apparatus according to claim 2 wherein said cascade refrigeration system uses ethylene and methane as refrigerants.

4. An apparatus according to claim 2 wherein said expander is a turboexpander.

5. An apparatus according to claim 2 wherein after said expander reduces the pressure of said natural gas stream, said natural gas stream is at a pressure between about 600 psig and about 650 psig and at a temperature below about 0° F.

6. An apparatus according to claim 1 further comprising:

a first flow conduit having a first end operatively connected between said pretreater means and said expander and having a second end operatively connected between said expander and said refrigeration means to form a parallel bypass flow path for said natural gas stream; and a Joule-Thomson valve interposed in said first flow conduit, said Joule-Thomson valve being selectively closable to preclude flow of said natural gas stream when said expander is in service and openable to allow flow of said natural gas stream and effect a reduction in the pressure of the feed stream when said expander is out of service.

7. An apparatus according to claim 1 further comprising:

means for converting the work extracted by said expander from said natural gas stream into mechanical or electrical energy, said means for converting work being operatively connected to said expander.

8. In a process for producing liquefied natural gas, a method of improving liquid natural gas production and conserving energy, comprising:

feeding a pressurized natural gas feed stream, at a pressure above about 800 psig and at about ambient temperature, to an expander means, prior to refrigeration of said feed stream;

conducting said feed stream through said expander to reduce the pressure of the stream to a pressure below about 650 psig and to cool the stream to a temperature below about 0° F.;

extracting work from the feed stream during the reduction of pressure by means of said expander; and feeding said feed stream from an outlet of said expander to a refrigeration cycle of said process to produce a liquefied natural gas stream at about atmospheric pressure and at a temperature below about −258° F.

9. A process according to claim 8 wherein said expander is a turboexpander.

10. A process according to claim 8 wherein said refrigeration cycle is a cascade cycle comprising:

(a) cooling said feed stream to a reduced temperature in at least one cooling stage by indirect heat exchange with a first refrigerant having a boiling point;

(b) cooling said feed stream in at least a first additional cooling stage by indirect heat exchange with a second refrigerant, having a boiling point lower than said first refrigerant's boiling point;

(c) compressing said first refrigerant after said step (a) to produce a compressed first refrigerant;

(d) cooling said compressed first refrigerant to produce a cooled first refrigerant;

(e) compressing said second refrigerant after step (b) to produce a compressed second refrigerant; and (f) cooling said compressed second refrigerant by indirect heat exchange with said cooled first refrigerant to produce a cooled second refrigerant.

11. A process according to claim 10 wherein said cascade cycle further comprises:

(g) cooling said feed stream in at least a second additional cooling stage by indirect heat exchange with a third refrigerant, having a boiling point lower than said second refrigerant's boiling point;

(h) compressing said third refrigerant after said step (g) to produce a compressed third refrigerant; and (i) cooling said compressed third refrigerant by indirect heat exchange with either said cooled first refrigerant or said cooled second refrigerant.

12. A process according to claim 8 further comprising pretreating the pressurized natural gas feed stream prior to feeding it to said expander means in order to remove carbon dioxide, hydrogen sulfide and water.

* * * * *